United States Patent [19]

Carretta et al.

[11] 3,951,583

[45] Apr. 20, 1976

[54] ROCKING-BEAM TYPE FURNACES

[75] Inventors: Ferdinando Carretta; Pietro Tixi, both of Genoa, Italy

[73] Assignee: Italimpianti Societa Italiana Impianti P.a., Genoa, Italy

[22] Filed: Aug. 5, 1974

[21] Appl. No.: 494,971

[30] Foreign Application Priority Data

Aug. 8, 1973 Italy ..... 12789/73

[52] U.S. Cl. ..... 432/124; 432/11

[51] Int. Cl.[2] ..... F27B 9/14

[58] Field of Search ..... 432/11, 122, 124

[56] References Cited

UNITED STATES PATENTS

| | | | |
|---|---|---|---|
| 2,620,174 | 12/1952 | Passafaro | 432/124 |
| 2,983,498 | 5/1961 | MacGregor | 432/124 |
| 3,373,980 | 3/1968 | Borgkvist | 432/11 |

FOREIGN PATENTS OR APPLICATIONS

| | | | |
|---|---|---|---|
| 1,331,410 | 8/1963 | France | 432/124 |

*Primary Examiner*—John J. Camby

*Attorney, Agent, or Firm*—Edwin E. Greigg

[57] ABSTRACT

In a rocking-beam type furnace which comprises fixed support beams which extend lengthwise of the furnace and conveyor beams which are parallel to the fixed beams and which can be raised and lowered and moved back and forth, the upper edges of the fixed beams and of the conveyor beams are provided with transverse billet locating notches having inclined billet supporting surfaces so that billets are intermittently and progressively rotated about their longitudinal axes during their passage through the furnace until they have performed at least one full rotation.

2 Claims, 14 Drawing Figures

ROCKING-BEAM TYPE FURNACES

BACKGROUND OF THE INVENTION

1. Field of the Invention

The invention relates to improvements in rocking-beam type furnaces for heating billets or the like.

2. Description of the Prior Art

As is known, rocker-bar type heating furnaces, sometimes called walking beam heating furnaces, are provided with axed support beams which extend lengthwise of the interior of the furnace, and with conveyor beams which are parallel to the fixed beams and which can be raised and lowered and moved back and forth. The movement of the billets through the furnace is effected intermittently by raising, shifting in the direction of passage and depositing the billets, the conveyor beams being raised until their upper edges project above the upper edges of the fixed beams, causing the billets to be raised from the fixed beams and to rest on the conveyor beams. Subsequently the raised conveyor beams are moved in the direction of the delivery port of the furnace, the billets being thus moved onward by a corresponding step. Then the conveyor beams are lowered again to such an extent that their upper edges are below the upper edges of the fixed beams, causing the advanced billets to be again deposited on the fixed beams. The lowered conveyor beams are finally returned for carrying out the next conveying step.

With furnaces of this type as known, for example, from German Pat. No. 1,221,260, the billets are conveyed through the furnace parallel to themselves in such a manner that they always face upwards with the same surface. With these furnaces the upper horizontal billet surface is heated much more quickly than the lower horizontal billet surface. As a result of the temperature difference between the upper and the lower billet surfaces the billet will arc vertically outward towards the top. But also the forward vertical billet surface as seen in the direction of travel will be heated more rapidly and intensely than the rear vertical billet surface as the hotter furnace zones are located in the discharge end section of the furnace. Due to the temperature difference resulting therefrom between the forward and rear billet surfaces the billet will also arc forward in a horizontal direction. The vertical, more particularly the combined vertical and horizontal billet deflection or deformation, caused by the difference in temperature of the opposite billet surfaces can assume such proportions that the billets tip over in the direction of travel. This complicates and occasionally completely prevents the discharge of the heated billets from the furnace, and often the operation of the furnace must be interrupted in order to eliminate these faults, i.e. to restore the deformed and tipped-over billets to their proper position by external means. In order to overcome these difficulties, the known methods of heating billets in rocking-beam type heating furnaces make it necessary to step up the heating of the billets gradually until the desired temperature has been reached, i.e. to use correspondingly long heating furnaces or to increase the passage time of the billets through the furnace.

It is an object of the invention to eliminate these drawbacks and to develop a method of heating billets or the like in rocking-beam type heating furnaces, by means of which undesirable or excessive deflection or deformation, caused by excessive temperature differences between opposite sides of the billet surfaces, with consequent tipping movements of the billets in conjunction with shorter passage times of the billets through the furnace or in conjunction with a greater specific heat intake of the billets per unit length of the furnace is avoided.

SUMMARY

According to the invention the above mentioned drawbacks are overcome by the billets being intermittently and progressively rotated about their longitudinal axes during their passage through the furnace until they have performed at least one full rotation. Preferably the billets, during each step of travel through the length of the furnace are rotated about their longitudinal axis by an angle of less than 360°.

By the method according to the invention the billets, as they pass through the furnace, are thus intermittently rotated about their longitudinal axis until they have completed at least one full rotation. In this manner the various or opposite billet surfaces are uniformly heated. The billets will neither deflect or deform but will maintain their substantially rectilinear shape and their correct position on the fixed and conveyor beams. There will thus be no difficulty in discharging the heated billets from the furnace, and there will be no need for interrupting the furnace operation for the purpose of eliminating difficulties in connection any incorrect position of the billets.

At the same time the heating furnace may be kept much shorter than heretofore, or the passage time of the billets through the furnace can be considerably increased. The uniform temperature of the billet surfaces permits a much more intense and speedy heating, i.e. the heat supply, particularly in the first furnace zone, and the temperature of the furnace space can be considerably increased without resulting in excessive temperature differences between various, in particular opposite, billet surfaces. The heat transfer from the furnace to the billets is thus much more intense, or more heat is transferred per unit time. The heat transfer is additionally promoted by the fact that after each rotational step of a billet the position of the most intensely heated and temporarily hottest e.g. upper billet surface is taken up by another and somewhat cooler billet surface, which leads not only to a unification of the billet temperature but also to a somewhat increased heat flow from the furnace space to the billet.

In a further development of the invention the rotary movement combined with the travel of the billets is restricted to an initial section of the furnace length and continued until the billet has reached such a temperature, e.g. approximately 750°–800°C for unalloyed steel at which the billet, under its own weight, deflects at an adequate deformation rate to prevent any upward bending. This variant of the method is based on the knowledge that the upward deflection and deformation of the billets due to the temperature difference between the upper and lower billet surfaces can occur only until the deflection of the billets caused by their own weight cannot balance out the upward bending process, i.e. occurs at a reduced rate or to an insufficient extent. When, however, the billet reaches a certain mean temperature which, for example is approximately 750°–800°C for unalloyed steel, the billet will deflect under its own weight to such an extent or at such a high rate that any bending in the opposite direction caused by the temperature difference between the upper and the lower billet surface is balanced out and practically cannot occur. In carrying the invention into effect the rotation of the billets about their longitudinal axis while passing through the furnace is continued only until the billets have reached the said temperature. This produces the advantage that the technical outlay for the intermittently progressive rotation of the billets about their longitudinal axis can be limited to just an initial section of the furnace length.

The invention also comprehends a rocking-beam type heating furnace for heating billets or the like, comprising fixed support beams which extend longitudinally of the furnace and conveyor beams which are parallel to the fixed beams and which can be raised and lowered and moved back and forth, wherein the upper edges of the fixed beams and of the conveyor beams are provided with continuous transverse billet locating notches having inclined billet support surfaces.

DESCRIPTION OF THE PREFERRED EMBODIMENT

Figure 7:
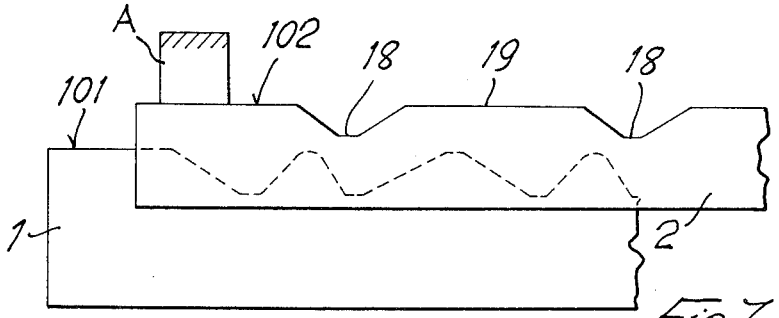
Figure 8:
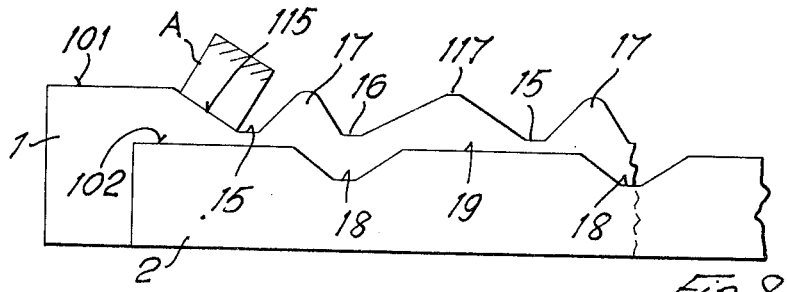
Figure 9:
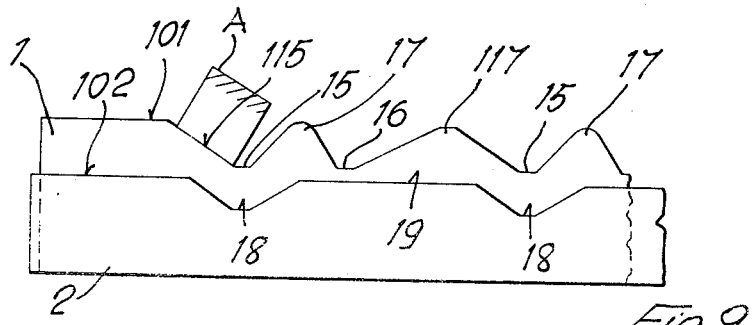

Referring to the drawings, the rocker-bar type heating furnace for billets A or the like is provided with fixed billet support beams 1 running along the longitudinal direction of the furnace, and with conveyor beams 2 which run parallel to the fixed beams 1 and which can be raised, lowered, and moved back and forth. The fixed beams 1 are secured on columns 3. Between any two fixed beams 1 a conveyor beam 2 is arranged. All conveyor beams 2 are simultaneously moved in such a manner that, for example, from a lowered position (FIGS. 1 to 3 and 5) they can be raised in the direction of the arrow F1 of FIG. 4 until their upper edges are about the upper edges of the fixed beams 1 (FIG. 6). Subsequently the raised conveyor beams 2 are moved forward in the direction of the billet travel, i.e. in the longitudinal direction of the rocker bar heating surface (FIG. 7) as shown by the arrow F2 in FIG. 4. Then the conveyor beams 2 are lowered again in the direction of the arrow F3 in FIG. 4 until their upper edges are below the upper edges of the fixed beams 1 (FIG. 8). Finally the lowered conveyor beams 2 are returned in the opposite direction to that of the billet travel, i.e. rearwards in the longitudinal direction of the furnace (FIG. 9) as shown by the arrow F4 in FIG. 4.

This cycling movement of the conveyor beams 2 can be obtained by any suitable kind of movement mechanism. In the embodiment shown in FIGS. 1 and 2 the conveyor beams 2 are secured in pairs to carrier frames 4, which can be moved back and forth in the longitudinal direction of the furnace, which are mounted on raisable and lowerable support frames 5, and locate the beams 2 of each pair adjacent opposite ends of a fixed beam 1. Each movable carrier frame 4 is carried by supporting rollers 6 which are freely rotatable on a support frame 5 and the frames 4 are moved back and forth by a double-acting cylinder 7 common thereto via the lever arm 8, a transverse rocker bar 9 carried by fixed mountings, and an operating linkage 10, 110, FIG. 1. The support frame 5 is moved back and forth by a rocking lever 12 mounted on fixed bearings, a rod 112 which extends lengthwise in the longitudinal direction of the furnace, i.e. in the direction of the arrows F2 and F4 in FIG. 4. The support frame 5 carries rollers 13 which roll on fixed inclined support surfaces 14 and move the support frame 5 up and down in the direction of the arrows F1 and F3 together with the carrier frame 4 and the conveyor beams 2 attached thereto.

Figure 3:
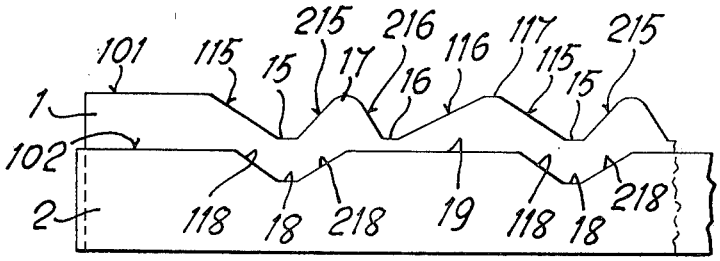
FIG. 3 is a lateral projection of a fixed beam and a conveyor beam section.
Figure 4:
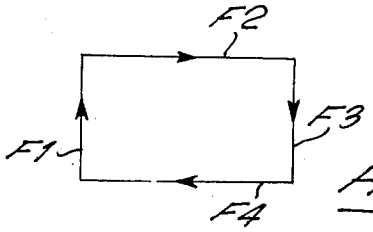
FIG. 4 is a diagram illustrating the pattern of motion of the conveyor beams.

The upper edges of the fixed beams 1 are each provided with transverse continuous billet locating notches 15, 16 having an unsymmetrical trapezoidal section with one flatter side surface 115 or 116 and one steeper side surface 215, 216 as shown in FIG. 3. The steeper side surfaces 215 of the billet locating notches 15 of the fixed beams are directed rearward in relation to the direction of passage of the billets through the heating furnace, whilst the flatter side surfaces 115 of the billet locating notches 15 are directed forward in the direction of passage of the billets through the furnace.

Conversely the steeper side faces 216 of the billet locating notches 16 of the fixed beams 1 are directed rearward and the flatter side faces 116 of the billet locating notches 16 are directed forward in relation to the direction of passage of the billets through the heating furnace. The billet locating notches 15, 16 are arranged alternatingly and invertedly in relation to one another in the upper edges of the fixed beams 1 in such close sequence that the steeper side faces, 215, 216 converge into a tooth 17 and the flatter side faces 115, 116 converge into a tooth 117 in pairs.

The upper edges of the conveyor beams 2 are also provided with continuous transverse billet locating notches 18 which have a symmetrical trapezoidal section. The oppositely arranged side faces 118, 218 of these billet locating notches 18 have the same inclination which approximately corresponds to the inclination of the flatter side faces 115 or 116 of the billet locating notches 15 or 16 of the fixed beams 1. The billet locating notches 18 in the upper edges of the conveyor beams 2 are spaced in such a manner that horizontal sections 19 of the upper edges of the conveyor beams 2 remain between them.

Figure 1:
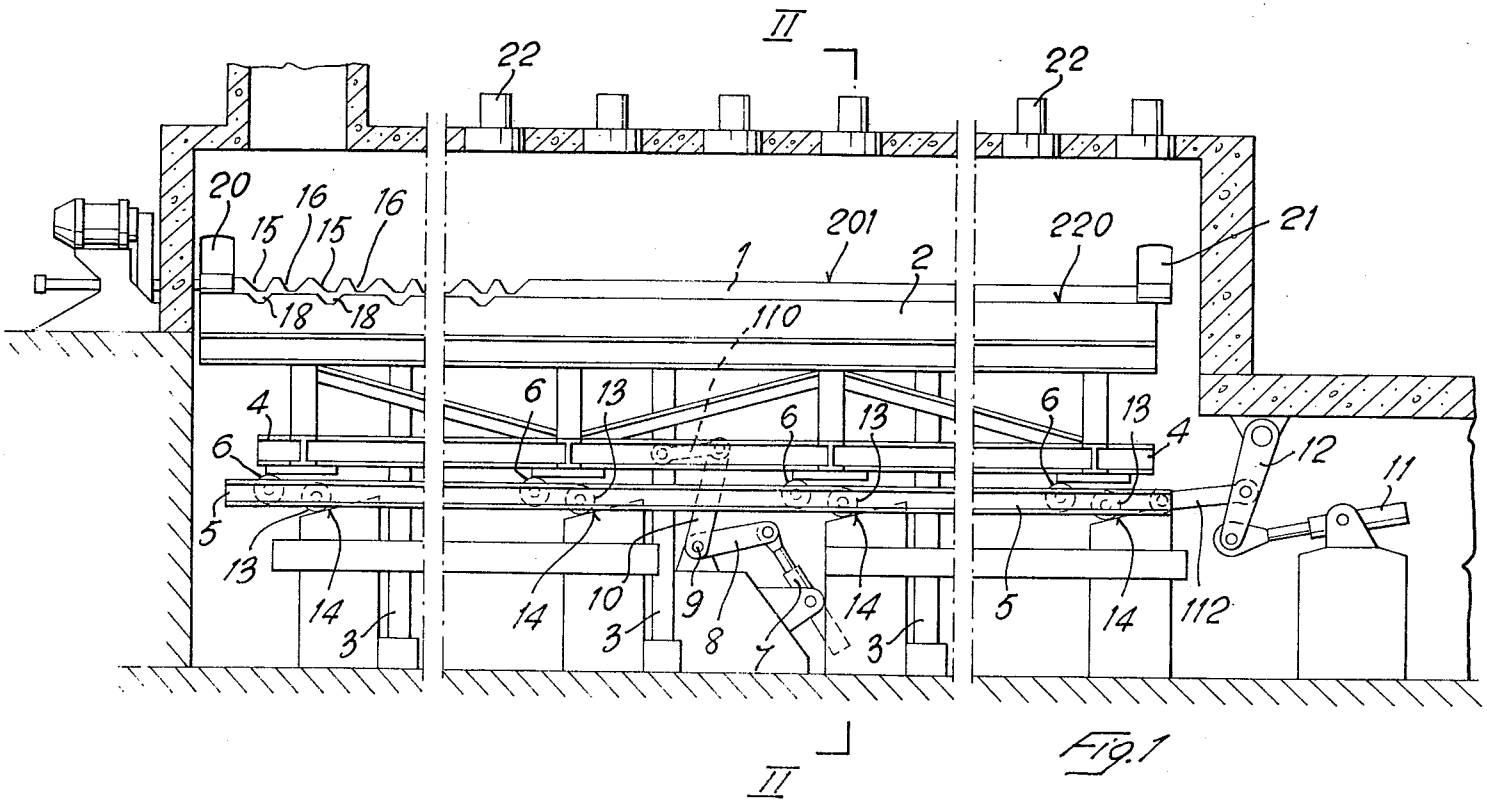
FIG. 1 is a vertical longitudinal section through a rocker-bar type heating furnace according to the invention.
Figure 2:
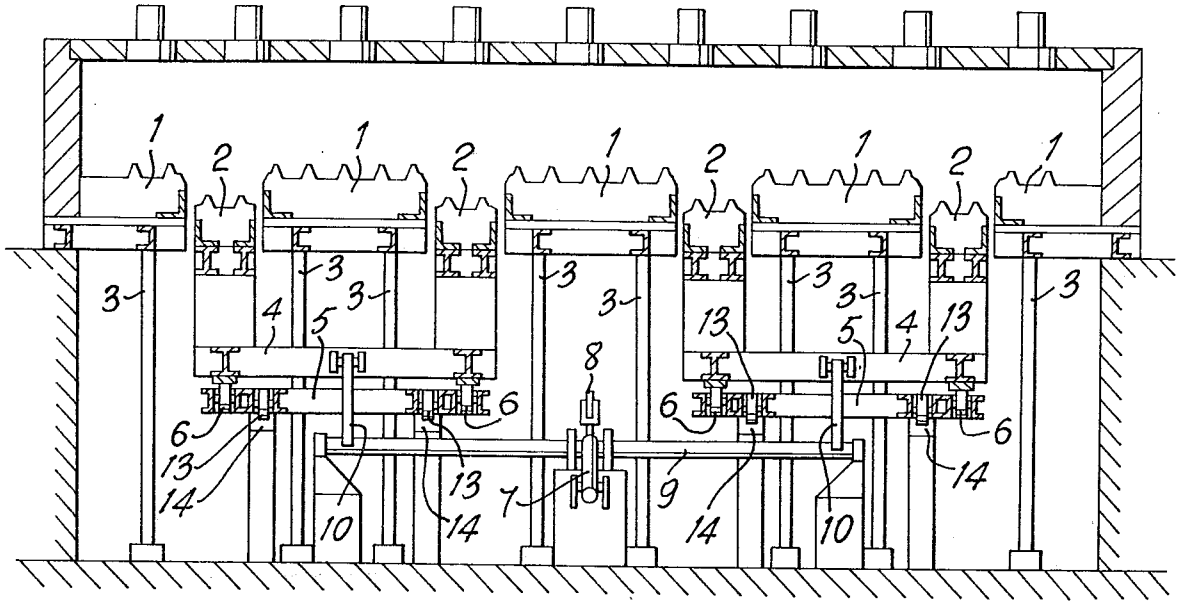
FIG. 2 is a section on line II—II of FIG. 1.

The billet locating notches 15, 16, 18 in the upper edges of the fixed and conveyor beams 1, 2 are provided only on an initial section of the furnace length, as shown in FIG. 1. In the area of the lateral inlet port 20 of the furnace the upper edges of the fixed beams 1 and of the conveyor beams 2 are each provided with a short horizontal initial portion 101, 102 respectively. The lateral discharge port of the furnace is designated 21. The burners 22 are fitted in the roof of the furnace.

The mode of operation of the beams 1, 2 for intermittently advancing the billets A, which are directed transversely to the beams, through the furnace in conjunction with the intermittent rotation of the billets A about their longitudinal axis will now be described with reference to FIGS. 5 to 14. In order to illustrate the rotary movement of the billets A the billet surface originally situated on top has been shaded.

Figure 5:
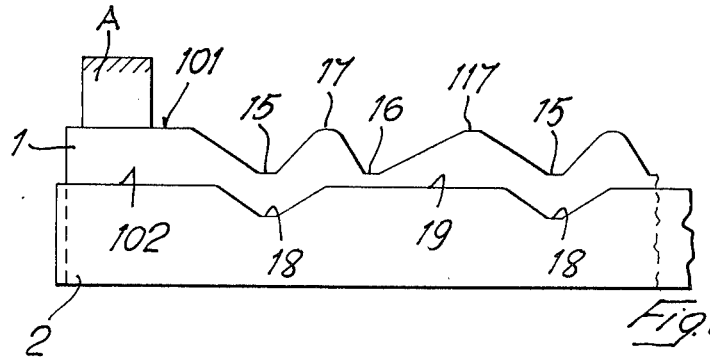
FIGS. 5 to 14 show the interaction of the fixed and conveyor beams illustrated in FIG. 3 for the intermittent movement of a billet through the furnace with simultaneous intermittent rotation of the billet about its longitudinal axis.
Figure 6:
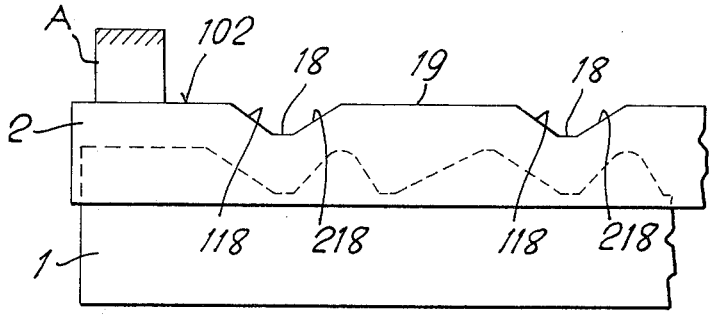

A billet A inserted through the feed port 20 of the furnace is deposited on the horizontal initial section 101 of the fixed beam 1 while the conveyor beams 2 are lowered and retracted (FIG. 5). Subsequently the conveyor beams 2 are raised in the direction of the arrow F1 and lift the billet A off the fixed beam 1 by their initial level portions 102 (FIG. 6). Now the raised conveyor beams 2 are advanced together with the billet A by one step along the furnace in the direction of the arrow F3 (FIG. 7) after which they are lowered in the direction of the arrow F3 (FIG. 8). The billet A is thus deposited on the more flatly inclined side surface 115 of the first billet locating notch 15 of the fixed beams 1 and is consequently rotated forward in the direction of travel by an angle corresponding to the inclination of the side surface 115 in relation to its position previously occupied according to FIGS. 5 to 7.

Figure 12:
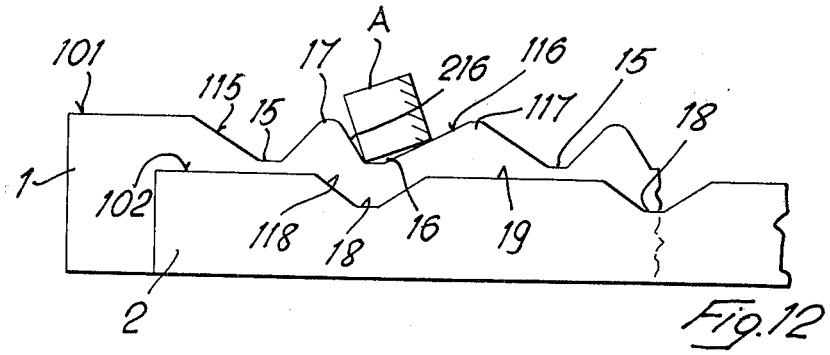
Figure 13:
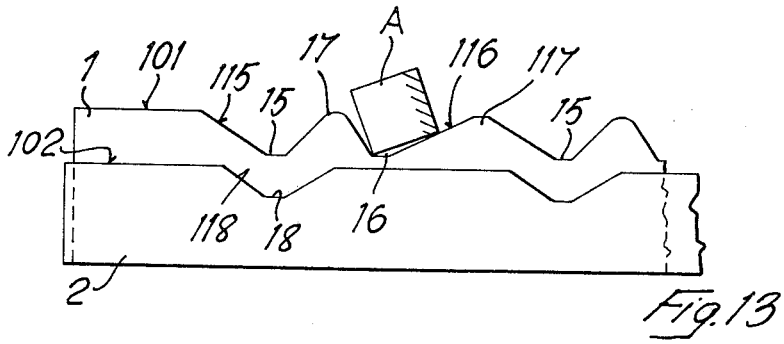
Figure 14:
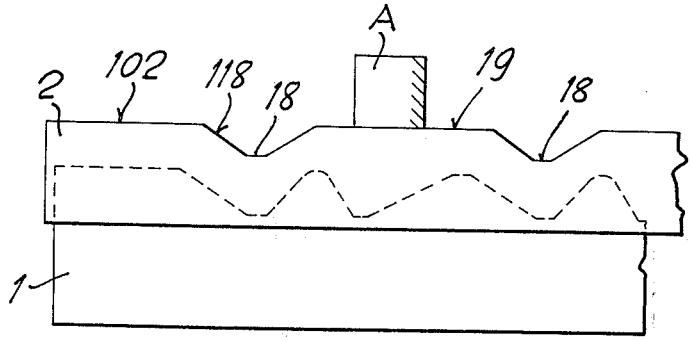
Figure 10:
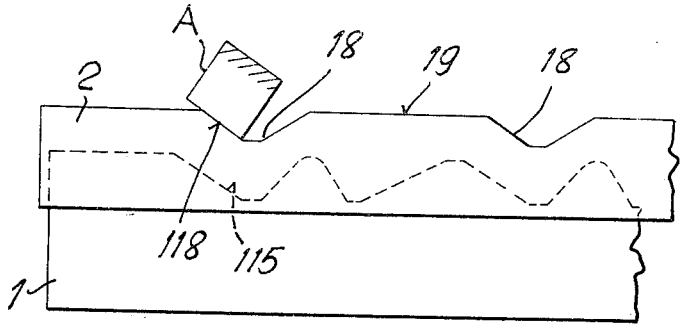
Figure 11:
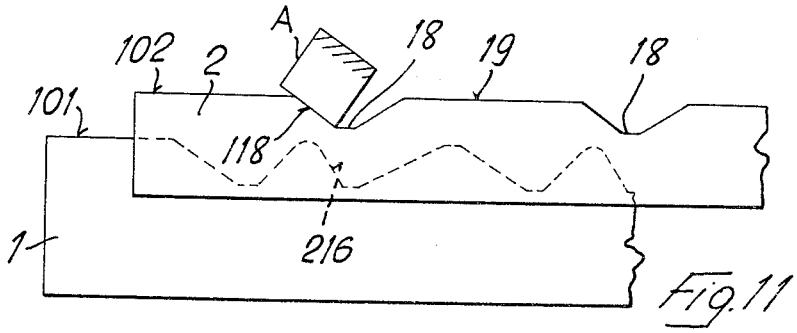

The lowered conveyor beams 2 are retracted in the direction of the arrow F4 (FIG. 9) and are then raised in the direction of arrow F1 (FIG. 10) during which movement they raise the billet A with the sloping side surface 118 of their first billet locating notch 18 from the fixed beam 1. This side surface 118 of the billet locating notch 18 of the conveyor beams 2 having approximately the same inclination as the flatter side surface 115 of the billet locating notch 15 of the fixed beams 1, the billet A lifted off the fixed beam 1 retains its previous oblique position as shown in FIG. 10. The conveyor beams 2 are then again advanced in the direction of the arrow F2 in the direction of travel of the billets by one step (FIG. 11) and subsequently lowered again in the direction of arrow F3, during which process they deposit the billet A on the steeper side surface 216 of the next billet locating notch 16. However, this side surface 216 of the billet locating notch 16 is so steep that the billet A, which has already been placed in an oblique position, cannot support itself on it but tips over in a forward direction and comes to rest on the opposite flatter side surface 116 of the billet locating notch 16 of the fixed beams 1 (FIG. 12). This causes the billet A to be moved by a further step in the direction of travel and, at the same time, to be rotated by a further angle about its longitudinal axis. Subsequently the lowered conveyor beams 2 are retracted in the direction of arrow F4 (FIG. 13) and then again raised in the direction of arrow F1, during which movement they lift the billet A off the fixed beams 1 (FIG. 14) by means of their horizontal section 19 between two consecutive billet locating notches 18. The billet A, previously obliquely positioned on the fixed beams 1 (FIG. 13) now comes to rest on the horizontal section 19 of the upper edge of the conveyor beams 2 and is thus rotated further about its longitudinal axis in the direction of travel. By this time the billet A has performed a rotation or rolling-off movement of altogether 90°, so that the originally upper horizontal billet surface is now facing vertically forward.

The rotation of the billet A about its longitudinal axis in the course of its travel through the furnace is continued in the manner described above until the billet has performed at least one full rotation and reaches a temperature at which its plastic deformability reaches such an extent that the deflection caused by the own weight of the billet prevents any upward bending of the billet due to the temperature differences between the upper and the lower billet surfaces. For unalloyed steel billets this temperature is in the region of 750° to 800°C, more particularly 780°C, and is normally reached only near the end of the first third of the furnace length. In this case, therefore, the fixed and conveyor beams 1, 2 will be provided only in the first third of their length with billet locating notches 15, 16 18 with sloping support or tipping surfaces 115, 116, 216, 118 for producing the intermittent rotation of the billets about their longitudinal axis. Subsequently the fixed and conveyor beams 1, 2 may have a continuous rectilinear and horizontal upper edge 201 or 202 as shown in FIG. 1.

The advantages of the furnace according to the invention over known designs can be seen from the numerical example given below. This concerns a furnace for heating unalloyed steel billets having a square section of 150 × 150 mm. These billets are to be heated from 20°C to 1250°C ± 5°C. The fixed and conveyor beams are 10 meters long, and each advancing step is 250 mm.

With the known design of rocking beam heating furnace in which the billets are not rotated about their longitudinal axis the passage time of a billet through the furnace is about 1 hour and 15 minutes. At the end of the first third of the furnace length, i.e. after some 25 minutes, the billet will have an average temperature of 780°C, but the temperature difference between the upper and the lower billet surfaces will be approximately 200°C. Consequently the risk of bending, particularly in an upward direction, with subsequent tipping movements of the billets and the risk of having to stop operations in order to eliminate such trouble is quite considerable.

With the furnace according to the invention, however, in which the billets are intermittently and progressively rotated about their longitudinal axis while passing through the furnace, the billets will have the same average temperature of 780°C at the end of the first third of the furnace length, but the temperature difference between the upper and the lower billet surface — with the same heat supply as in the known furnace — will be only about 45°C. As this temperature difference can be increased to some 120°C without any serious risk of deflection, deformation or tilting of the billet, the heat supply in the first furnace zone may be considerably increased. Consequently the average temperature of the billet of 780°C is reached in 20 instead of 25 minutes, the temperature difference between the upper and the lower surface of the billet still not exceeding the safety value of 120°C.

The remaining passage time through the furnace can be reduced from the 50 minutes previously required to approximately 48 minutes since the billet during its passage through the first third of the furnace length, during which it has been rotated, has been heated much more uniformly, so that the time required for subsequent levelling out of the temperature can be correspondingly shortened. Altogether, therefore, the heating time is reduced from 75 minutes to 68 minutes, i.e. by 10 percent. With identical performance, therefore, the furnace according to the invention may be 10% shorter than that of previously known furnaces. At the same time breakdowns or down-times due to deflection, deformation or tilting of the billets are precluded, i.e. the operational reliability of the furnace is increased.

We claim:

1. In a rocking beam type furnace for heating billets or the like, the arrangement which comprises:

a plurality of fixed support beams which extend longitudinally of the furnace, each fixed support beam having an upper surface defining a first series of continuous transverse billet locating notches with inclined billet support surfaces for approximately a first third of the furnace length; and a plurality of conveyor beams, which are parallel to and in alternate arrangement with said fixed support beams, each conveyor beam having an upper surface defining a second series of continuous transverse billet locating notches with inclined billet support surfaces for approximately a first third of the furnace length, which plurality of conveyor beams can be raised and lowered, and longitudinally reciprocated, relative to said plurality of fixed support beams, wherein each billet locating notch of said first series of notches has a symmetrical trapezoidal profile, and is separated from adjacent billet locating notches of said first series of notches by horizontal billet support sections of the upper side of said conveyor beams.

2. A furnace arrangement as described in claim 1, wherein each billet locating notch of said second series of notches has an unsymmetrical trapezoidal profile, with one flatter surface serving as a supporting surface for the billets and one steeper side surface acting as a tipping surface for the billets, said unsymmetrical trapezoidal billet locating notches being arranged alternatingly and laterally reversed in relation to one another, with the flatter and steeper side surfaces respectively converging into the shape of a tooth.

* * * * *